US007841399B2

(12) United States Patent
Holt, Jr. et al.

(10) Patent No.: US 7,841,399 B2
(45) Date of Patent: Nov. 30, 2010

(54) PRESSURE AND FRICTION REDUCING FLOW ADAPTER

(75) Inventors: James H. Holt, Jr., Willis, TX (US); Joel M. Riggs, Alvin, TX (US); Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 102 days.

(21) Appl. No.: 12/138,735

(22) Filed: Jun. 13, 2008

(65) Prior Publication Data

US 2009/0308597 A1 Dec. 17, 2009

(51) Int. Cl.
*E21B 33/00* (2006.01)
*E21B 47/00* (2006.01)
*E21B 49/00* (2006.01)

(52) U.S. Cl. ..... 166/238; 166/316; 175/50

(58) Field of Classification Search ..... 166/316, 166/217, 115, 369, 386, 162, 181, 242.1, 166/206, 66, 143, 68, 368

See application file for complete search history.

(56) References Cited

U.S. PATENT DOCUMENTS

| | | | | |
|---|---|---|---|---|
| 3,856,081 | A * | 12/1974 | Canalizo | 166/123 |
| 4,842,064 | A * | 6/1989 | Gazda | 166/250.07 |
| 5,893,414 | A * | 4/1999 | Shaposhnikov et al. | 166/191 |
| 7,147,058 | B1 * | 12/2006 | Shaposhnikov et al. | 166/370 |
| 2003/0019301 | A1 * | 1/2003 | Richards et al. | 73/861.53 |
| 2005/0252653 | A1 * | 11/2005 | Vanderford et al. | 166/75.14 |

* cited by examiner

*Primary Examiner*—Shane Bomar
*Assistant Examiner*—Michael Wills, III
(74) *Attorney, Agent, or Firm*—Shawn Hunter

(57) ABSTRACT

A flow adapter includes an adapter body which defines a central axial flow bore and one or more lateral flow openings for fluid communication between the central flow bore and a production tubing flowbore surrounding the adapter. The central axial flow bore of the flow adapter provides a flow restriction which creates a pressure drop across the flow adapter. The flow restriction may be in the form of a conically tapered flowbore wherein the downstream end of the flowbore has a diameter that is less than the diameter of the upstream end of the flowbore.

17 Claims, 5 Drawing Sheets

PRESSURE AND FRICTION REDUCING FLOW ADAPTER

BACKGROUND OF THE INVENTION

1. Field of the Invention

The invention relates generally to devices and methods for reducing and countering the friction forces resulting from the production of fluids.

2. Description of the Related Art

When a stationary object is in the path of fluid flow, it will experience two types of flow-induced forces. Pressure forces are created by integration of pressure that is distributed along the surfaces that are exposed to the pressures. Friction forces are created by the viscous effect exerted by the flow along exposed surfaces. Those forces are normally at one order of magnitude lower than the pressure forces. The net pressure force results from the pressure differential or pressure drop across the object. While the viscous force is always in the same direction as the flow next to the wall of the object, the pressure force including its direction and magnitude is subjected to the changing of the characteristics of the flow field. One typical example is VIV (Vortex-Induced-Vibration) of marine line-like structures. In a flow field, a vortex or a circulation is always related to a low pressure region.

These pressure and friction forces are significant in wells wherein there are high production flow rates. Locks are often used to secure flowmeters and other instrumentation inside production tubing, and these locks can actually become unset and flowed out of the production string by the fluid pressure and friction forces resulting from high flow rates within the production string.

SUMMARY OF THE INVENTION

The present invention provides systems and methods for securely retaining flowmeters, sensors and other instrumentation within a production string. The devices and methods of the present invention provide a secure retaining arrangement even in the presence of high fluid flow rates through the production tubing. In a preferred embodiment, an instrumentation package is retained within the flowbore of a production tubing string by a releasable, wireline-run lock which is secured into a generally complimentary nipple within the flowbore. Also in a preferred embodiment, a flow adapter is incorporated below the lock and above the instrumentation package.

An exemplary flow adapter includes an adapter body which defines a central axial flow bore and one or more lateral flow openings for fluid communication between the central flow bore and the production tubing flowbore surrounding the adapter. The central axial flow bore of the flow adapter provides a flow restriction which creates a pressure drop across the flow adapter. In a preferred embodiment, the flow restriction is in the form of a conically tapered flowbore wherein the downstream end of the flowbore has a diameter that is less than the diameter of the upstream end of the flowbore. Also in a preferred embodiment, the total flow area provided by the lateral flow openings is greater than the flow area provided by the downstream end of the central flowbore of the flow adapter.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
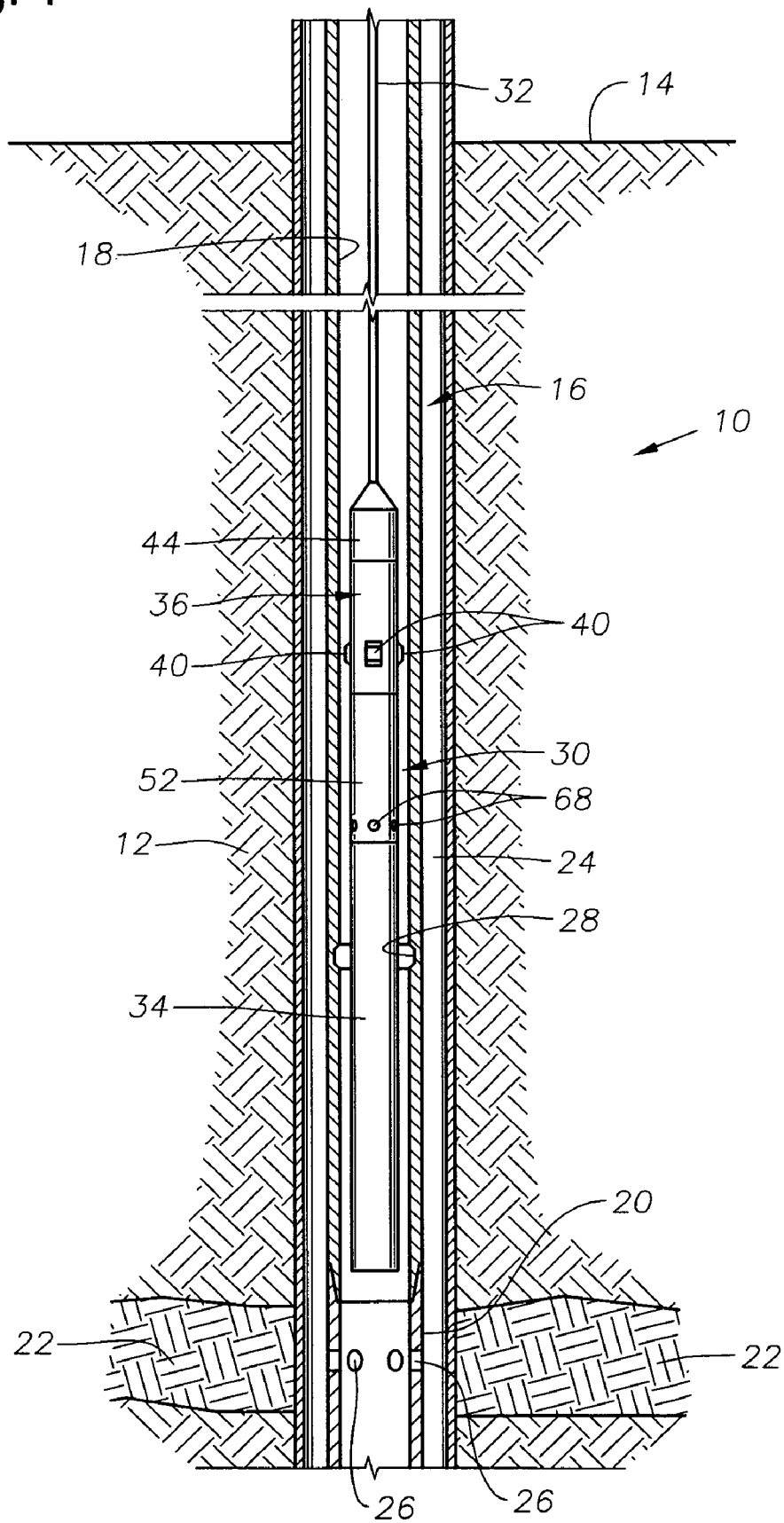
FIG. 1 is a side, cross-sectional view of an exemplary production assembly which incorporates a work tool having a flow adapter constructed in accordance with the present invention.

FIG. 1 depicts an exemplary hydrocarbon production wellbore 10 that has been drilled through the earth 12 from the surface 14. A production tubing assembly 16 is disposed within the wellbore 10. The production tubing string 16 is of a type well known in the art that is made up of individual sections of production tubing that are affixed in an end-to-end fashion and define an interior flowbore 18 along its length. A ported production nipple 20 is incorporated into the production tubing string 16 and is located proximate a surrounding hydrocarbon-bearing formation 22. An annulus 24 is defined between the production tubing string 16 and the wellbore 10. Fluids entering the annulus 24 from the formation 22 flow into the flowbore 18 via ports 26 in the production nipple 20. It is further noted that the flowbore 18 of the production tubing string 16 contains a landing profile 28 above the production nipple 20.

FIG. 1 depicts a work tool, generally indicated at 30, being disposed into the flowbore 18 of the production string 16 via a wireline running string 32. The exemplary work tool 30 includes a flowbore monitoring package 34 of a type known in the art for detecting and recording certain wellbore parameters such as flow rate, temperature, pressure and so forth. In preferred embodiments, the monitoring package 34 includes a housing which contains one or more sensors, flowmeters and/or other measurement instrumentation of a type known in the art for detection of specific downhole conditions. In addition, the monitoring package 34 will typically include a data storage device or other recording apparatus for recording and/or storage of sensed information relating to the downhole parameters that are measured. Also, the monitoring package 34 will typically include one or more power sources, such as a battery for operation of the sensors, flowmeters, and/or other components.

The work tool 30 also includes a downhole lock 36, of a type known in the art, which can be selectively secured within the flowbore 18 of the production tubing string 16. The structure of an exemplary lock 36 can be better appreciated by further reference to FIG. 2, which depicts the lock 36 in greater detail. The lock 36 generally includes an outer lock housing 38 which carries a set of locking members, or locking dogs, 40 that can be moved radially inwardly and outwardly with respect to the housing 38. It is noted that the locking dogs 40 are shaped and sized to be complimentary to the landing profile 28 of the flowbore 18. An inner sleeve member 42 is retained within the housing and can be moved axially within the housing 38 by jarring motion of an attached lock running tool 44. Axial movement of the sleeve member 42 with respect to the housing 38 will cause the locking dogs 40 to be moved selectively inwardly or outwardly with respect to the housing 38. A suitable lock for use as the lock 36 is the SUR-SET™ wellbore lock available commercially from Baker Oil Tools of Houston, Tex. The releasable running tool 44 is secured to the wireline 32 and releasably secured to the lock 36 in a manner known in the art. The running tool 44 includes an enlarged upper head portion 46 and a radially reduced stinger 48 that extends downwardly therefrom and into the lock 36. The stinger 48 of the running tool 44 extends through a central lock flowbore 50 that is defined within the lock 36.

Figure 3:
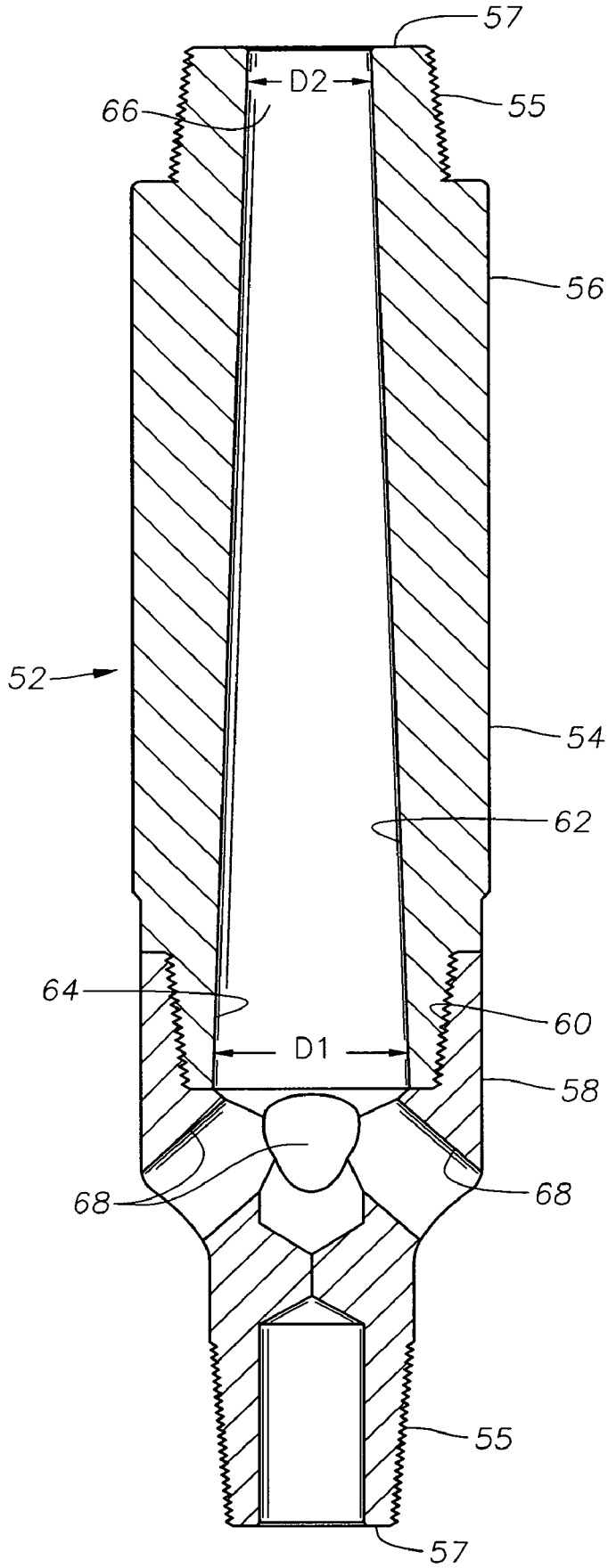
FIG. 3 is a side, cross-sectional view of an exemplary flow adapter from the work tool, shown apart from the other components of the work tool.

A flow adapter 52 is disposed between the lock 36 and the monitoring package 34. The flow adapter 52 permits fluid within the surrounding production tubing flowbore 18 to be transmitted radially inwardly and upwardly toward the lock 36. FIG. 3 depicts an exemplary flow adapter 52 in greater detail and apart from the other portions of the work tool 30. The exemplary flow adapter 52 includes a generally cylindrical flow adapter body 54 which is made up of upper and lower body portions 56, 58 that are affixed to one another via a threaded connection 60. The flow adapter body 54 defines a central axial flow bore 62 having a lower upstream, end 64 and an upper downstream, end 66. The flow bore 62 is conically tapered such that the upstream end 64 has a diameter (D1) that is greater than the diameter (D2) of the downstream end 66. Additionally, the flow adapter body 54 provides threaded connections 55 at its axial ends 57 to permit the adapter 52 to be affixed to the lock 36 and monitoring package 34.

Figure 7:
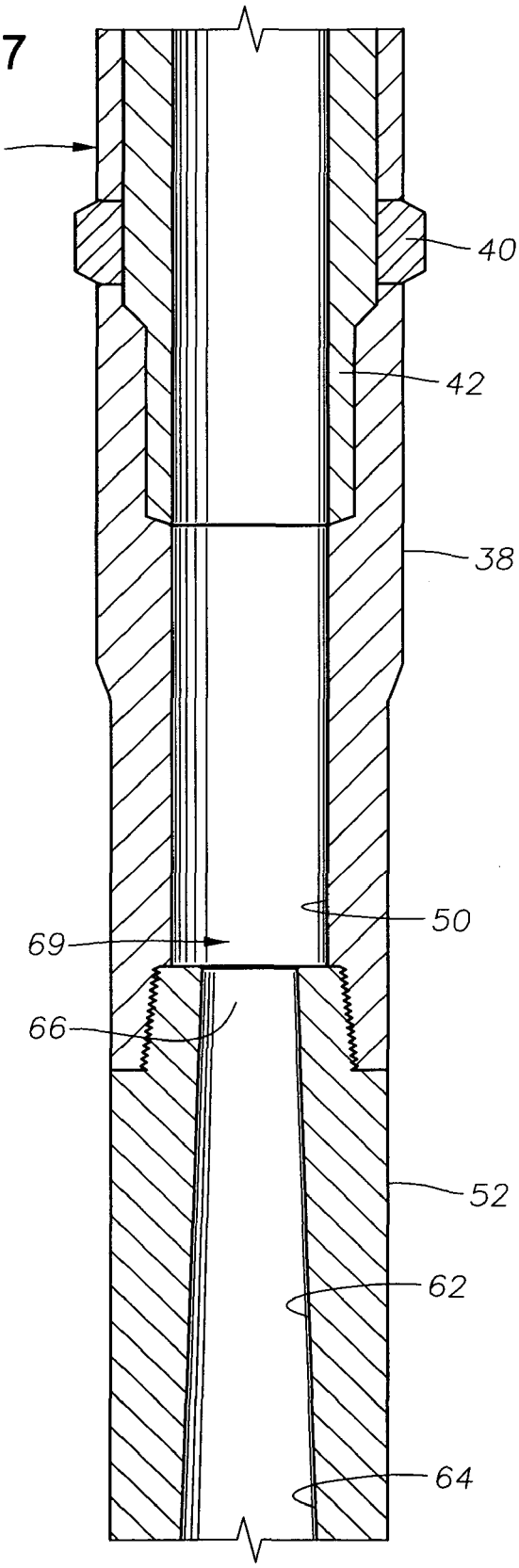
FIG. 7 is a side, cross-sectional schematic view depicting portions of an exemplary lock and attached flow adapter.

One or more fluid flow openings 68 are disposed through the lower body portion 58 of the flow adapter body 54 to provide fluid communication between the surrounding production tubing flowbore 18 and the upstream end 64 of the flow bore 62. It is preferred that the fluid flow openings 68 provide a first total flow area that is greater than the second flow area provided by the downstream end 66 of the flow bore 62. This will prevent fluid entering the upstream end of the flow bore 62 from becoming turbulent. In a particularly preferred embodiment, the total flow area of the fluid flow openings 68 is about twice the flow area of the downstream end 66. With reference to FIG. 7, it can be seen that the flow area provided by the downstream end 66 of the flow bore 62 is smaller than the third flow area provided by the flowbore 50 within the lock 36. As a result, an area 69 of low pressure is created within the lower end of the flowbore 50 within the lock 36.

Figure 2:
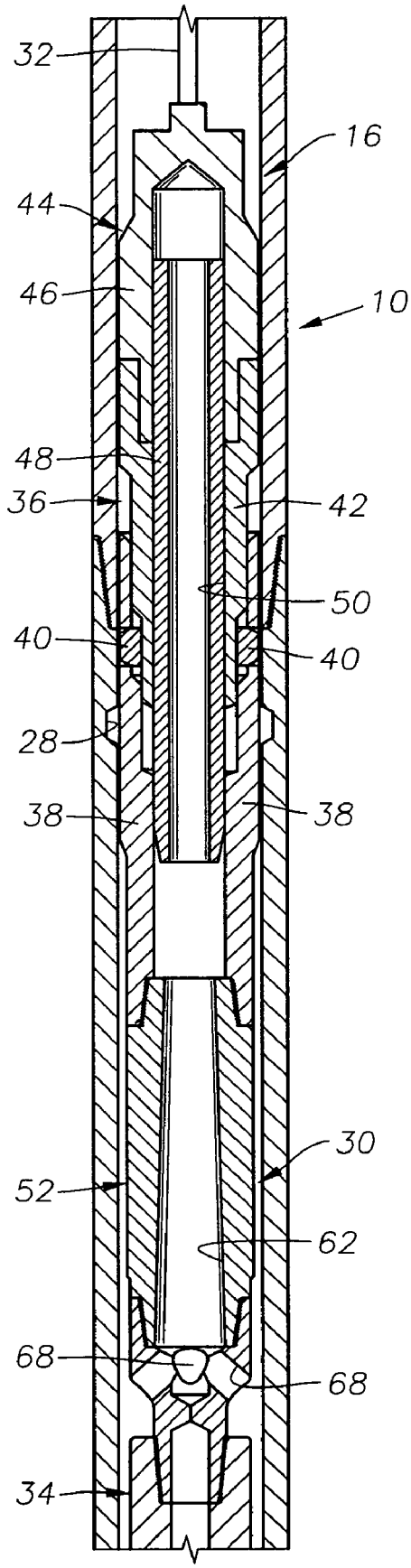
FIG. 2 is an enlarged cross-sectional view of portions of the work tool shown in FIG. 1 in greater detail.
Figure 4:
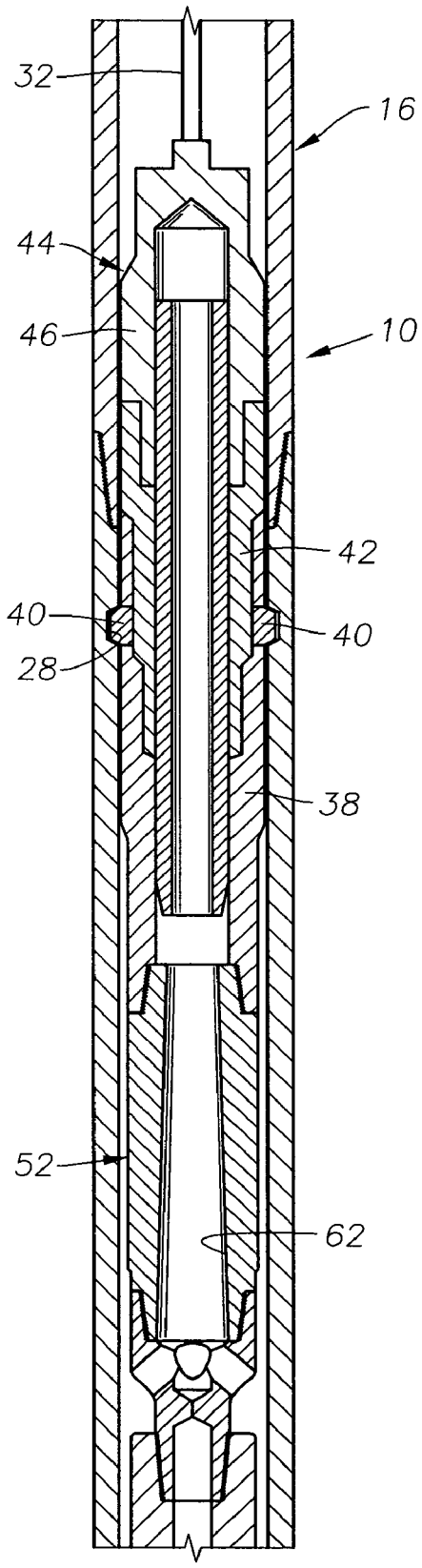
FIG. 4 is a side, cross-sectional view of the work tool shown in FIG. 1, now having been latched into the flowbore of the production tubing string.
Figure 5:
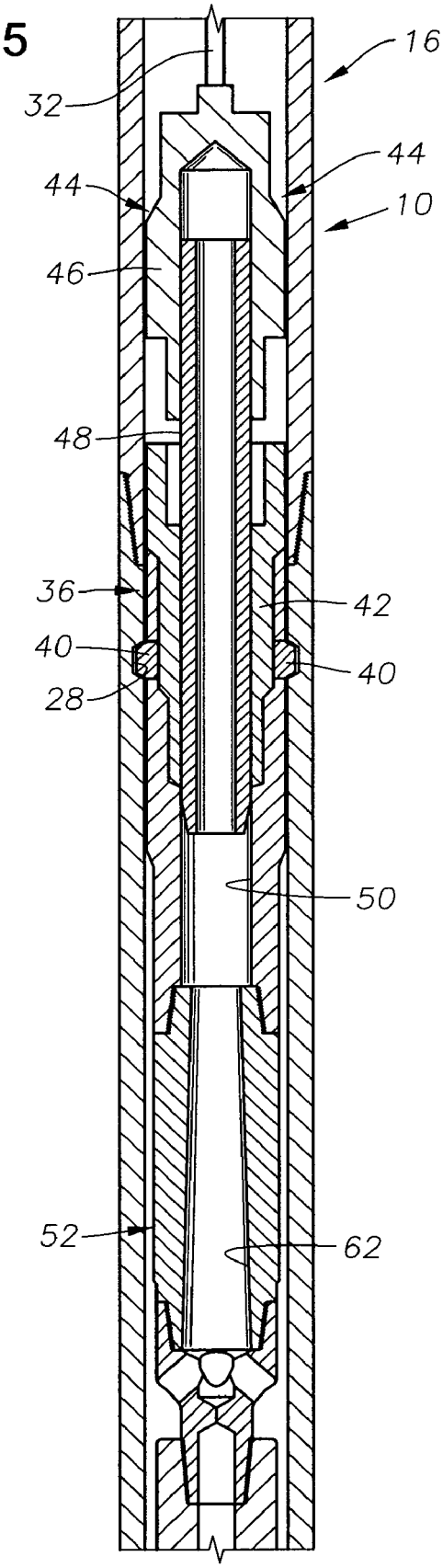
FIG. 5 is a side, cross-sectional view of the work tool shown in FIGS. 1, 3 and 4, now with the running tool being released from the lock.
Figure 6:
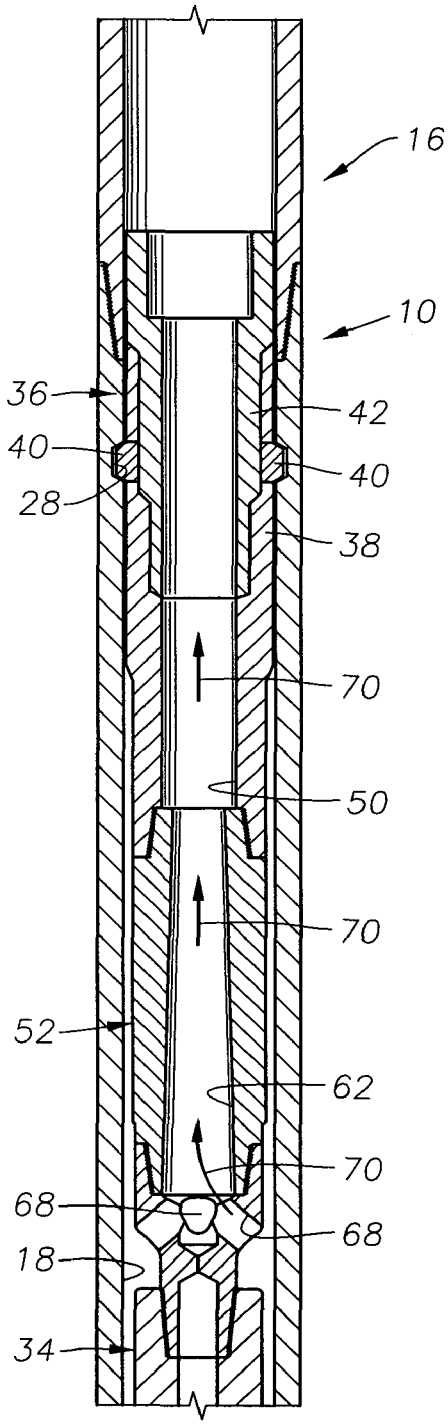
FIG. 6 is a side, cross-sectional view of the work tool shown in FIGS. 1 and 3-5, now used for production of hydrocarbon fluid.

In operation, the work tool 30 is disposed into the production string 16 by wireline 32, as depicted in FIGS. 1 and 2. The lock 36 is actuated in a manner known in the art to selectively secure the locking dogs 40 within the landing profile 28 (see FIG. 4). When the dogs 40 are so secured, the monitoring package 34 will be positioned proximate the production nipple 20, so that the monitoring package 34 may be used to monitor wellbore conditions relating to the flow of fluids through the nipple 20. One the lock 36 is engaged with the landing nipple 28, the running tool 44 is released from the lock 36 so that the stinger 48 is removed from the lock flowbore 50 of the lock 36 (see FIG. 5). Thereafter, the wireline 32 and running tool 44 are removed from the production tubing string 16. As FIG. 6 illustrates via flow arrows 70, production fluid is flowed from the flowbore 18 of the production tubing string 16 through the fluid openings 68 and into the central axial flowbore 62 of the flow adapter 52. As the fluid flows from the upstream end 64 to the downstream end 66 of the flow bore 62, a pressure drop occurs. This pressure drop results in the low pressure area 69 being created within the lower end of the flowbore 50 of the lock 36. As a result, the pressure and friction forces exerted upon the inner sleeve 42 of the lock 36 are reduced.

The flow adapter of the present invention is particularly well suited for attachment to wellbore locks that are set by an axially moveable inner sleeve, such as sleeve 42. A flow adapter constructed in accordance with the present invention provides improved operation of wellbore locks even in the presence of high fluid flow conditions that might otherwise cause the lock to become inadvertently unset by shifting of the inner sleeve of the lock by flowing fluids.

The lock 36 with the attached flow adapter 52 may be considered as an improved lock assembly which is capable of production of fluid at higher flow rates and pressures than a lock alone. The improved lock assembly is particularly useful for securing a monitoring device, such as monitoring package 34, within a production string and subsequently permitting production fluid to be produced through the lock assembly.

Those of skill in the art will recognize that numerous modifications and changes may be made to the exemplary designs and embodiments described herein and that the invention is limited only by the claims that follow and any equivalents thereof.

What is claimed is:

1. A flow assembly for attachment to a wellbore lock, the flow assembly comprising:

a flow adapter body having two axial ends, each axial end having a threaded connection;

a flow adapter defining a central axial flowbore having an upstream end and a downstream end;

a lateral flow opening disposed through the flow adapter body to provide fluid communication between the upstream end and a production tubing flowbore surrounding the flow adapter body; and wherein the central axial flowbore provides a flow restricted portion to reduce the fluid pressure of fluid entering the lock.

2. The flow assembly of claim 1 wherein the central axial flowbore is tapered so that the downstream end has a smaller diameter than the upstream end, thereby providing the flow restricted portion of the flowbore.

3. The flow assembly of claim 1 wherein the lateral flow opening provides a first flow area and the downstream end of the flowbore provides a second flow area, and wherein the first flow area is larger than the second flow area.

4. The flow assembly of claim 3 wherein the first flow area is about twice as large as the second flow area.

5. A lock assembly for securing a device within a production tubing string and permitting flow of production fluid through the lock assembly, the lock assembly comprising:

a) a lock comprising:

a lock housing defining an axial lock flowbore;

a locking member that is moveable with respect to the lock housing to selectively secure the lock within the production tubing string;

b) a flow adapter affixed to the lock and comprising:

a flow adapter body having two axial ends, each axial end having a threaded connection;

the flow adapter defining a central axial flowbore having an upstream end and a downstream end;

a lateral flow opening disposed through the flow adapter body to provide fluid communication between the upstream end and a production tubing flowbore surrounding the flow adapter body; and wherein the central axial flowbore provides a flow restricted portion to reduce the fluid pressure of fluid entering the lock.

6. The lock assembly of claim 5 wherein the central axial flowbore of the flow adapter is tapered so that the downstream end has a smaller diameter than the upstream end, thereby providing the flow restricted portion of the flowbore.

7. The lock assembly of claim 5 wherein the lateral flow opening provides a first flow area and the downstream end of the flowbore of the flow adapter provides a second flow area, and wherein the first flow area is larger than the second flow area.

8. The lock assembly of claim 7 wherein the first flow area is about twice as large as the second flow area.

9. The lock assembly of claim 7 wherein the lock flowbore provides a third flow area and wherein the second flow area is smaller than the third flow area.

10. The lock assembly of claim 9 wherein the second flow area creates a low pressure area within the third flow area.

11. The lock assembly of claim 5 wherein the lock further comprises an inner sleeve that is axially moveable with respect to the lock housing and axial movement of the inner sleeve with respect to the lock housing will actuate the locking member between radially inner and outer positions.

12. A work tool to be disposed within a production tubing string for monitoring of wellbore conditions within the tubing string, the work tool comprising:

a) a lock comprising:

a lock housing defining an axial lock flowbore;

a locking member that is moveable with respect to the lock housing to selectively secure the lock within the production tubing string;

b) a flow adapter affixed to the lock and comprising:

a flow adapter body having two axial ends, each axial end having a threaded connection;

the flow adapter defining a central axial flowbore having an upstream end and a downstream end;

a lateral flow opening disposed through the flow adapter body to provide fluid communication between the upstream end and a production tubing flowbore surrounding the flow adapter body;

wherein the central axial flowbore provides a flow restricted portion to reduce the fluid pressure of fluid entering the lock;

c) a monitoring package affixed to the flow adapter for monitoring at least one wellbore condition within the production tubing string.

13. The work tool of claim 12 wherein the central axial flowbore of the flow adapter is tapered so that the downstream end has a smaller diameter than the upstream end, thereby providing the flow restricted portion of the flowbore.

14. The work tool of claim 13 wherein the lateral flow opening provides a first flow area and the downstream end of the flowbore of the flow adapter provides a second flow area, and wherein the first flow area is larger than the second flow area.

15. The lock assembly of claim 14 wherein the first flow area is about twice as large as the second flow area.

16. The lock assembly of claim 14 wherein the lock flowbore provides a third flow area and wherein the second flow area is smaller than the third flow area.

17. The lock assembly of claim 16 wherein the second flow area creates a low pressure area within the third flow area.

* * * * *